United States Patent [19]

Grime

[11] Patent Number: 4,730,753

[45] Date of Patent: Mar. 15, 1988

[54] PAINT CUP VENT

[75] Inventor: Thomas E. Grime, Temperance, Mich.

[73] Assignee: Champion Spark Plug Company, Toledo, Ohio

[21] Appl. No.: 453,407

[22] Filed: Dec. 27, 1982

[51] Int. Cl.[4] ..... B65D 51/16

[52] U.S. Cl. ..... 222/481; 220/374; 222/630; 222/478

[58] Field of Search ..... 222/478, 481, 484, 630; 220/366, 367, 373, 374, 378

[56] References Cited

U.S. PATENT DOCUMENTS

| | | | |
|---|---|---|---|
| 2,701,668 | 2/1955 | Zayan | 222/484 |
| 3,240,398 | 3/1966 | Dalton | 222/481 X |
| 3,858,756 | 1/1975 | Fulton | 220/374 X |
| 3,921,849 | 11/1975 | Fernberg et al. | 220/373 X |
| 4,036,393 | 7/1977 | Neiman | 220/374 X |
| 4,307,820 | 12/1981 | Binoche | 220/374 |
| 4,394,928 | 7/1983 | Philip | 220/374 X |

FOREIGN PATENT DOCUMENTS

| | | |
|---|---|---|
| 247071 | 11/1947 | Switzerland . |
| 887480 | 1/1962 | United Kingdom . |
| 977809 | 12/1964 | United Kingdom . |

*Primary Examiner*—Kevin P. Shaver

*Attorney, Agent, or Firm*—MacMillan, Sobanski & Todd

[57] ABSTRACT

A paint cup assembly for a suction feed paint spray gun having an improved drip free vent. An annular groove forming a tortuous vent passage in the lid is covered by a gasket which seals the lid to the paint cup. Removal of the gasket provides access to the vent passage for cleaning. In a modified embodiment, a valve is provided selecting either a direct vent passage or a tortuous drip free vent passage.

11 Claims, 13 Drawing Figures

FIG. 3
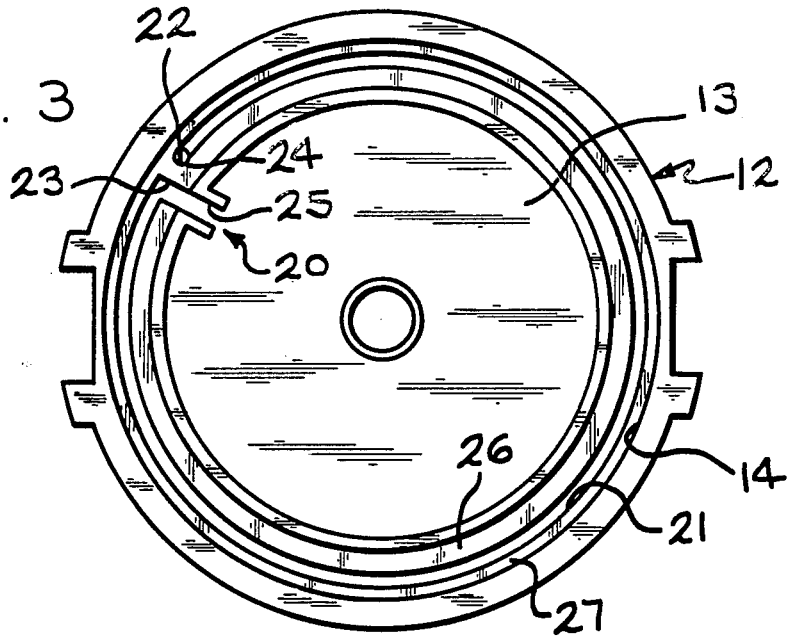
FIG. 7
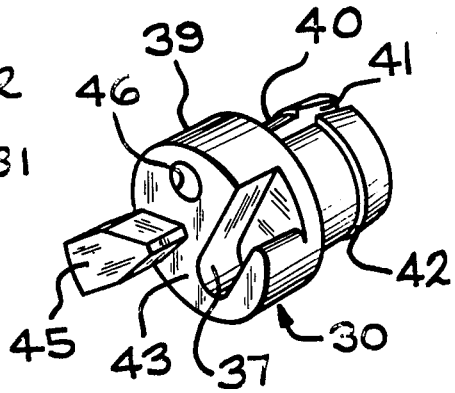
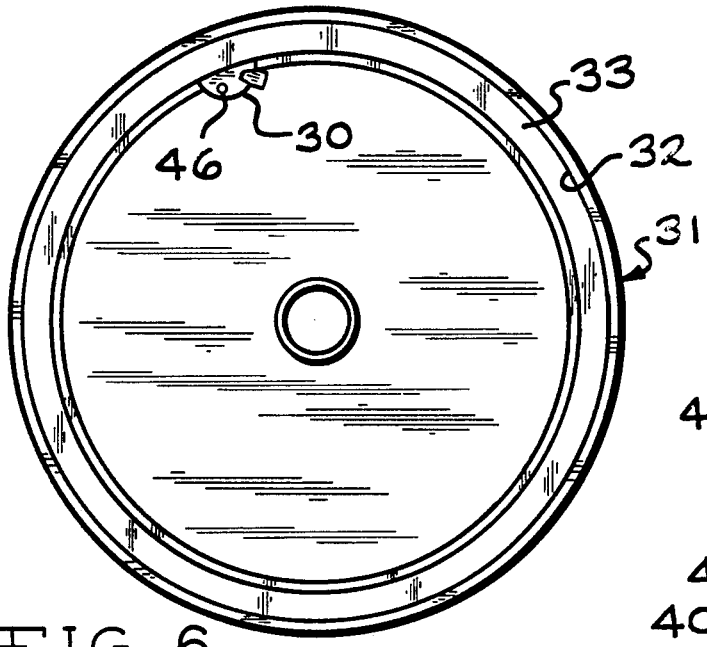
FIG. 6
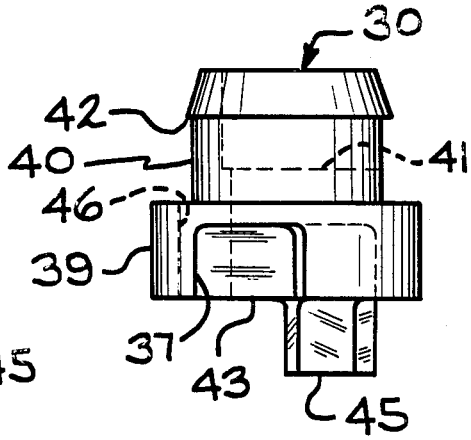
FIG. 9
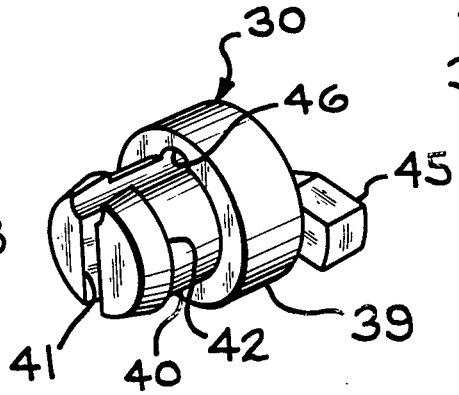
FIG. 8

PAINT CUP VENT

BACKGROUND OF THE INVENTION

This invention relates to a vented paint cup or container for a suction feed hand held paint spray gun and more particularly to an improved tortuous passage vent structure which eliminates dripping from the paint cup vent as the spray gun is tilted during operation and is easily cleaned after use.

In one commonly used type of spray gun, compressed air is supplied through the spray gun to a nozzle. As the compressed air flows through the spray gun, suction resulting from the flow of the air to the nozzle draws paint from a paint cup and carries the paint to the nozzle where the air and entrained paint are discharged. As the paint is discharged from the nozzle, the air breaks up and atomizes the paint and carries the paint towards a workpiece for coating the workpiece. In order to apply a quality coating, it is necessary to maintain the spray gun perpendicular to the surface being coated. When workpiece surfaces have different configurations, it is necessary to tilt the spray gun in order to maintain the spray gun perpendicular to the workpiece surface. In order to prevent paint from dripping from the paint cup onto the workpiece as the spray gun is tilted and moved, the paint cup is sealed. However, the paint cup must be vented to equalize the pressure within the paint cup as paint is consumed. Without a vent, a vacuum will build up within the paint cup as paint is consumed and eventually paint flow to the nozzle will cease.

Various vent structures have been used in the past for allowing the air pressure within the paint cup to equalize with the atomosphere. The simplest structure is merely a vent hole formed in the paint cup lid. Such an arrangement works quite well provided that the paint cup is not tilted to the point that the vent opening is below the paint surface level within the paint cup. If the spray gun is tilted to the point that the vent opening is below the surface level, dripping may occur and if paint drips onto the workpiece the surface finish will be damaged. Various improvements have been made on this simple vent structure including the provision of a check valve within the vent opening or the provision of a vent passage which forms a tortuous path. When a tortuous path has been provided for the vent opening, the passages are often very small and difficult to clean. One vent of this type comprises a curved tube which lies within the paint cup lid. The vent tube must be removed from the lid for cleaning. Even when the tube is removed, only the ends of the tube provide access for cleaning.

SUMMARY OF THE INVENTION

According to the present invention, an improved tortuous passage vent structure is provided in a paint cup lid to prevent dripping when the paint cup is tilted, but which is easily cleaned. In a modified embodiment, a valve is provided for selecting either a direct vent opening or a tortuous passage vent opening.

The paint cup assembly generally comprises the cup which holds the paint and a lid which seals against an upper rim on the paint cup. A first annular groove extends around the interior portion of the lid which is adjacent the cup rim. A resilient gasket is positioned within the first groove for forming a fluid tight seal between the cup and the lid. In accordance with the present invention, a second annular groove is formed in the lid adjacent the first groove. The second groove is formed with a side which opens into the first groove and, when the gasket is positioned within the first groove, the open side is closed by the gasket. A first passage in the lid connects one portion of the second groove to the interior of the paint cup and a second passage which is spaced from the first passage connects the second groove with atmosphere. Thus, air is allowed to flow from the atmosphere through the second passage, the annular second groove and the first passage into the paint cup for equalizing pressure within the paint cup as paint is consumed. Preferrably, the second annular groove extends the majority of the distance around the paint cup lid, but slightly less than 360 degrees around the lid. Thus, the second groove is provided with two ends, one of which communicates with the first passage and the other which communicates with the second passage.

In a modified embodiment of the invention, a valve is located within the paint cup lid between the first passage and the adjacent end of the second annular groove. Or, the valve may totally replace the first passage. The valve is designed such that in a first valve position venting takes place through the tortuous path formed by the second groove and in a second valve position a substantially direct vent connection is made between the paint cup and atmosphere, avoiding all or substantially all of the second groove. In both embodiments, the vent passages are readily cleaned by removing the lid from the paint cup and then removing the gasket from the first groove in the lid to expose the second groove along its entire length. Where a valve is provided for changing the vent connections, the valve also is exposed for easy removal and cleaning when the gasket is removed.

Accordingly, it is an object of the invention to provide an approved vent structure for a paint cup which prevents dripping of paint from the vent when the paint cup is tipped and also is easily cleaned.

Other objects and advantages of the invention will become apparent from the following detailed description, with reference being made to the accompanying drawings.

BRIEF DESCRIPTION OF THE DRAWINGS

FIG. 3 is a bottom view of a lid for the paint cup assembly of FIG. 1, with the sealing gasket removed to show the vent passage;

FIG. 6 is a bottom view of the lid for the paint cup assembly of FIG. 4, with the sealing gasket installed;

FIG. 7 is perspective view of the valve member in the paint cup assembly of FIG. 4;

FIG. 8 is another perspective view of the valve member of FIG. 7;

FIG. 9 is a side elevational view of the valve member of FIG. 7;

DESCRIPTION OF THE PREFERRED EMBODIMENTS

Figure 1:
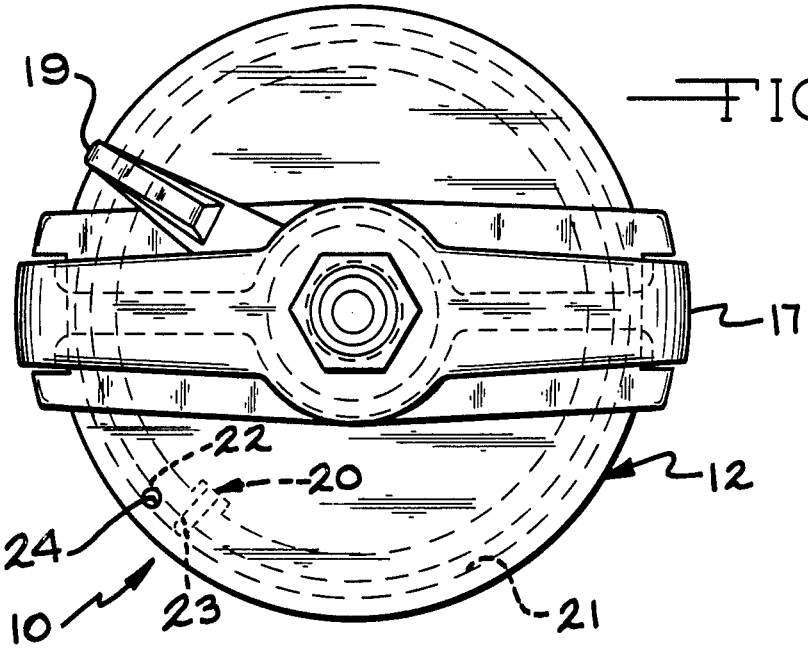
FIG. 1 is a top plan view of a section feed paint cup assembly constructed in accordance with the present invention.
Figure 2:
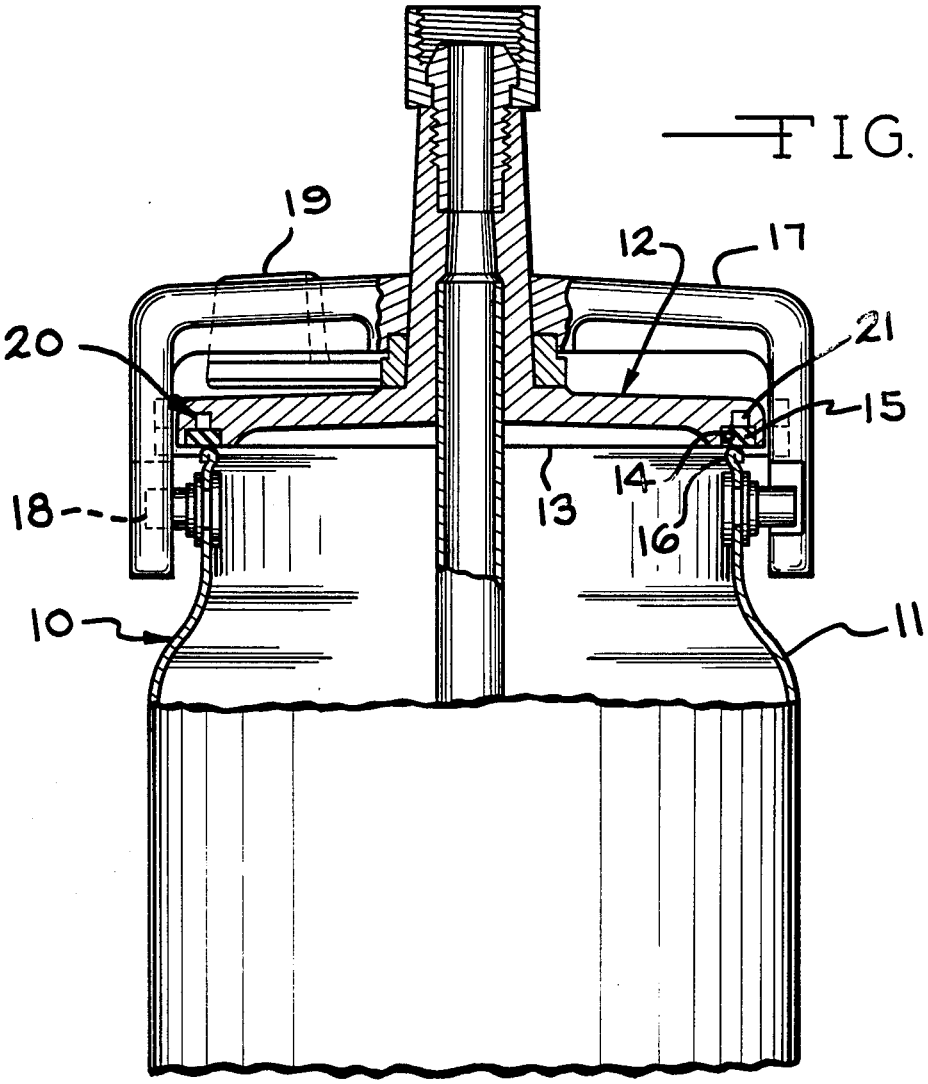
FIG. 2 is a fragmentary and partially broken away side elevational view of the paint cup assembly of FIG. 1.
Figure 4:
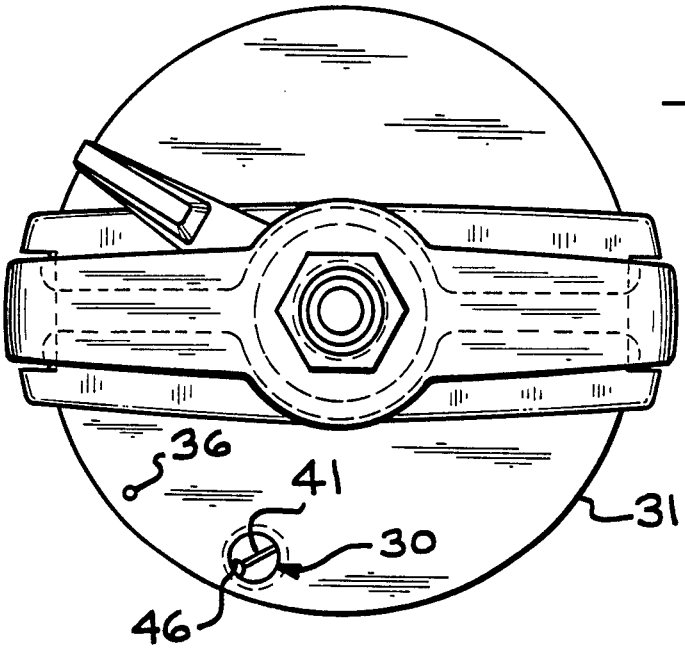
FIG. 4 is a top plan view of a suction feed paint cup assembly constructed in accordance with a modified embodiment of the invention.
Figure 5:
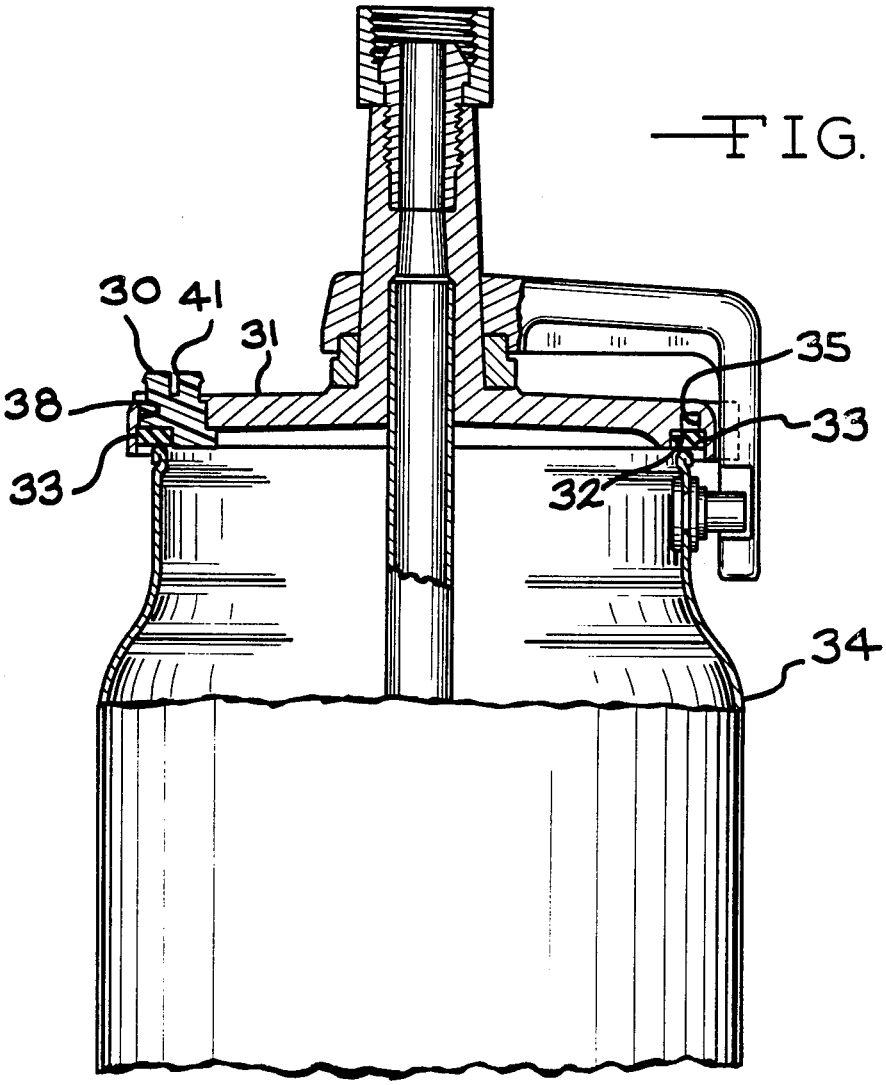
FIG. 5 is a fragmentary and partially broken away side elevational view of the paint cup assembly of FIG. 4.

Turning now to the drawings and particularly to FIGS. 1 and 2, a suction feed paint cup assembly 10 is shown for use with a conventional air atomization paint spray gun (not shown). The assembly 10 generally comprises a cup or jar 11 which holds a supply of paint and a lid 12 which closes the cup 11. The lid 12 has a lower or interior surface 13 which defines an annular groove 14 in which a resilient gasket 15 is located. When the lid 12 is positioned on the cup 11, the gasket 15 is located to abut and seal against an upper rim 16 on the cup 11 to prevent the paint from dripping from the cup assembly 10 when the cup assembly 10 is tilted during operation of the spray gun. The lid is attached to the cup 11 by any conventional manner and in the embodiment shown a bail 17 engages pins 18 on the cup 11 and a cam lever 19 is rotated to force the lid 12 against the cup rim 16 to compress the gasket 15. Of course other known arrangements for attaching the lid 12 to the cup 11 may be used.

In accordance with the present invention, an improved paint vent structure 20 is provided within the lid 12, as illustrated in FIGS. 1–3. A second annular groove 21 is provided in the lid 12 to abut and lie within the first groove 14. Preferably, the second groove 21 extends slightly less than 360 degrees about the lid 12 and has a first end 22 and a second end 23. The first groove end 22 connects to a passage or opening 24 through the lid 12 and the second groove end 23 connects through a passage 25 to the interior of the paint cup 11. The second groove 21 is formed to lie within and open through the first groove 14 to facilitate cleaning of the groove 21 and the passages 24 and 25. When the resilient gasket 15 is positioned within the groove 14, the gasket 15 completely covers the open side of the annular groove 21 and the open side portion of the passage 25 abutting the groove 14. The gasket 15 abuts and seals against interior annular surfaces 26 and 27 in the groove 14 which lie on either side of the groove 21 to prevent fluid leakage between the groove 21 and both the interior and exterior of the paint cup 11. This seal is maintained by pressure exerted by the cup rim 16 against the gasket 15 when the lid 12 is mounted on the cup 11.

When the lid 12 is mounted on the cup 11 and the suction feed cup assembly 10 is operated with a spray gun, atmosphere air flows inwardly through the first passage 24, around the second annular groove 21 and through the second passage 25 to equalize the air pressure within the cup assembly 10 as paint is consumed. Because of the tortuous vent path provided by the groove 21 and the displacement between the passages 24 and 25, the spray gun and attached paint cup assembly 10 may be tilted to the point that the passage 25 is located below the liquid surface level without paint dripping from the cup assembly 10. After painting is completed or whenever it is necessary to clean the vent passage, it is a simple matter to remove the lid 12 from the cup 11 and then remove the gasket 15 from the lid 12 to expose the tortuous vent passages formed by the groove 21, the passage 24 and the passage 25.

It will be noted that the drawings shows the annular groove 21 extending nearly 360 degrees about the interior of the lid 12. It will be appreciated that the groove 21 may extend less than 360 degrees. As the length of the groove 21 is decreased and the passages 24 and 25 are moved closer together, the degree to which the paint cup assembly 10 may be tilted without dripping will be reduced. It also should be appreciated that the annular groove 21 may extend continuously for a full 360 degrees about the interior surface of the lid. When the groove 21 extends continuously around the lid 12, and the passages 24 and 25 will be located at most 180 degrees apart when they are located on opposite sides of the lid. Although such an arrangement reduces the protection against dripping when the cup assembly 10 is tilted to certain positions, this arrangement still provides a tortuous vent path which is easily cleaned.

Under certain coating conditions, the paint cup assembly 10 will not be tilted significantly and it may be desireable to provide a direct vent rather than a tortuous path. In accordance with a modified embodiment of the invention illustrated in FIGS. 4–13, a valve member 30 is mounted in a paint cup lid 31 to allow the spray gun operator to select either direct vent or a tortuous path vent. The lid 31 is provided with an annular gasket receiving groove 32, which is similar to the groove 14 in the lid 12 of FIGS. 1–3, and is located to receive a gasket 33 which seals the lid 31 to a paint cup 34. A second annular groove 35 is located within the first annular groove 32 for forming a tortuous vent path between a passage 36 which extends through the lid 31 and a passage 37 in the valve member 30.

The valve member 30 is positioned within an opening 38 through the lid 31 to lie adjacent the vent groove 35. The valve member 30 has a stepped circular surface with an enlarged diameter end 39 in which the passage 37 is formed and a smaller diameter end 40 in which a screwdriver slot 41 is formed. A small flange 42 is provided on the small diameter end 40 to retain the valve member within the lid opening 38. The valve member 30 is inserted into the corresponding shaped opening 38 through the lie 31 so that the slot 41 is exposed to the exterior of the lid 31 and an inner surface 43 extends coplaner with an inner surface 44 of the first groove 32. Consequently, when the gasket 33 is positioned within the groove 32, the gasket 33 seals against both the interior surface 44 of the groove 32 and also against the abutting portions of the surface 43 of the valve member 30. The gasket 33 maintains it seal against the valve member surface 43 as the valve member 30 is rotated by means of a screwdriver (not shown) inserted into the slot 41.

Figure 10:
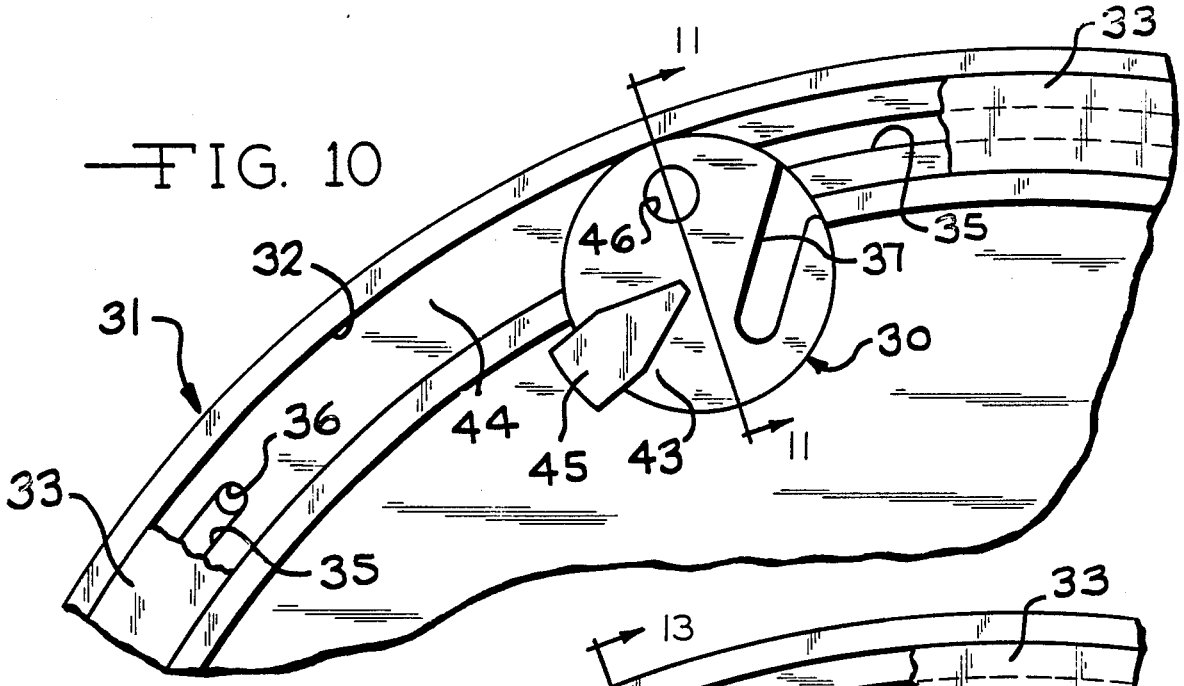
FIG. 10 is a fragmentary bottom view of the paint cup lid with the valve member position for providing a tortuous vent path.
Figure 12:
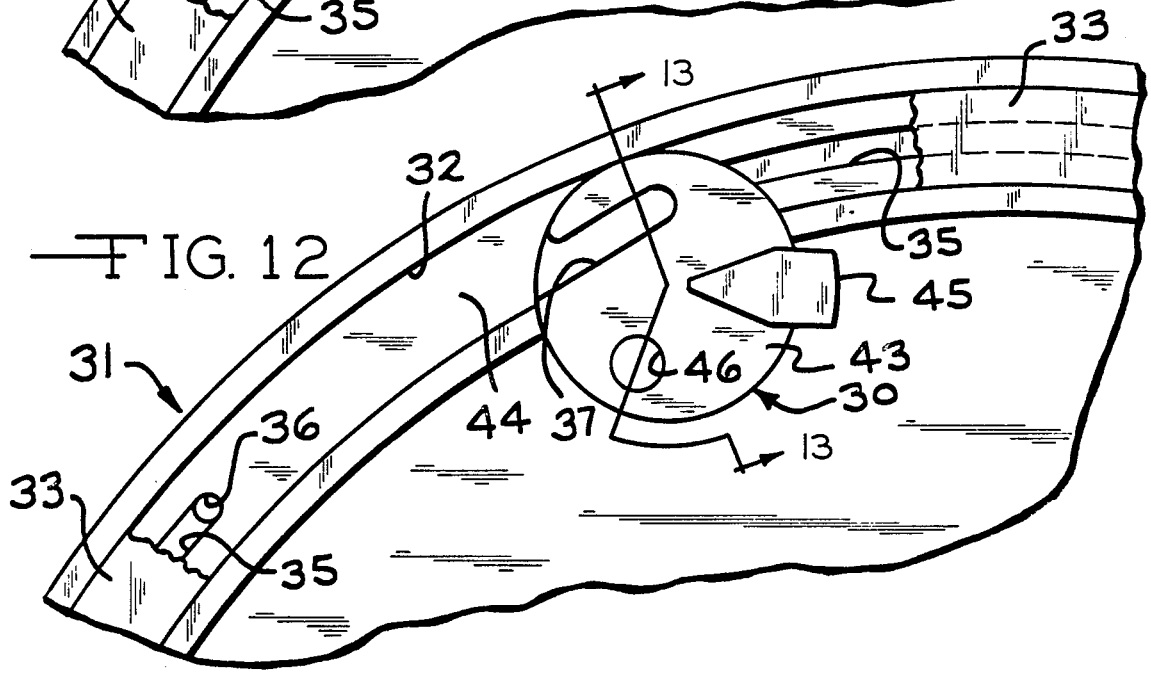
FIG. 12 is a fragmentary bottom view of the paint cup lid of FIG. 10, but showing the valve member positioned for providing a direct vent passage.
Figure 11:
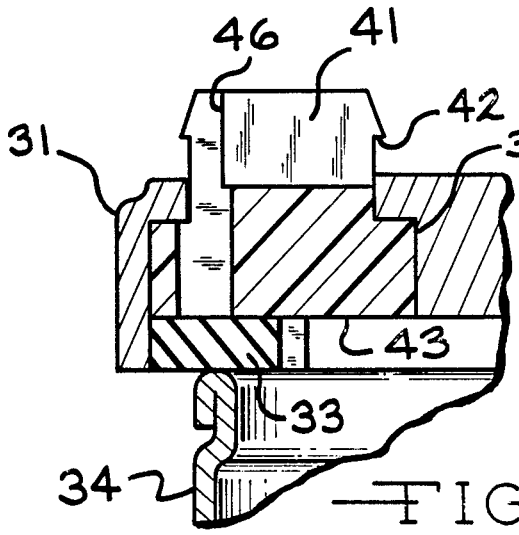
FIG. 11 is a cross sectional view taken along line 11—11 of FIG. 10.
Figure 13:
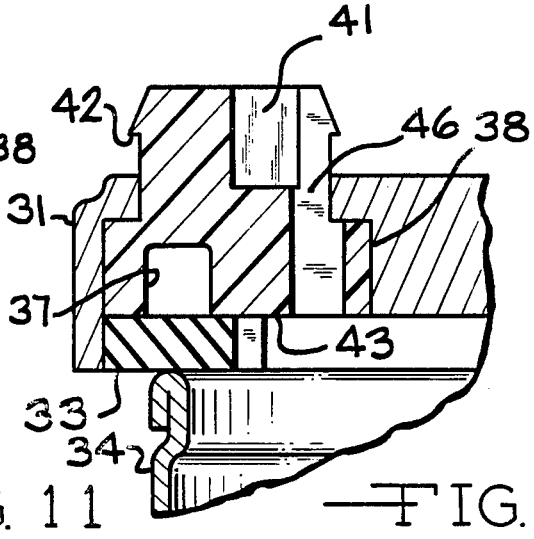
FIG. 13 is a cross sectional view taken along line 13—13 of FIG. 12.

A stop 45 projects from the valve member surface 43 for limiting rotation of the valve member 30 between first and second positions. In a first position, as illustrated in FIGS. 10 and 11, the gasket 33 seals a passage 46 which extends through the valve member 30 and the passage 37 is positioned to connect the second annular groove 35 with the interior of the paint cup 34. Accordingly, the interior of the paint cup 34 is vented through the tortuous path formed by the passage 37, the second groove 35 and the passage 36. In this position of the valve member 30, the paint cup 34 may be tilted without the risk of paint dripping from the vent passage. In the second position of the valve member 30, as illustrated in FIGS. 12 and 13, the passage 46 is no longer covered by the gasket 33 and, consequently, forms a direct vent opening connecting the interior of the paint cup 34 with atmosphere. When the valve member 30 is in this position, dripping will occur if the paint cup 34 is tilted until the surface of the paint within the cup 34 is located above the level of the vent passage 46.

Whenever it is necessary to clean the vent passages within the lid 31, it is a simple matter to remove the lid 31 from the paint cup 34 and remove the gasket 33 from the lid groove 32 to expose the vent passage formed by the annular groove 33 and the valve member 30. When necessary, the valve member 30 may be pushed from the lid opening 38 to facilitate cleaning of the valve member 30. Pushing on the valve member 30 also displaces the gasket 33 from the groove 32 to facilitate removal of the gasket. It should be noted that in both embodiments of the invention, no specialized tools are required for exposing and cleaning the vent passages.

It will be appreciated to those skilled in the art that various modifications and changes may be made in the above described preferred embodiments of the invention without departing from the spirit and the scope of the following claims. For example, the direct vent opening 46 in the valve member 30 may be eliminated and the valve member 30 can be provided with a passage connecting the interior of paint cup 34 directly to the passage 36 when the valve member 30 is in the direct vent position. In this arrangement, the groove 35 is extended from the arrangement shown in FIGS. 10 and 12 so that the groove 35 stops with the passage 36 adjacent the valve member 30. Also, similar results can be achieved by forming the annular vent groove as an integral part of the gasket rather than a part of the lid. Finally, it will be appreciated that the valve member 30 may be configured to slide instead of rotate.

What I claim is:

1. For a suction feed paint spray gun, an improved vented closure for a paint cup comprising a lid having a first annular groove positioned for abutting a rim on the paint cup and a second annular groove located within said first annular groove substantially in alignment with such cup rim when said lid is positioned on the cup rim, removeable gasket means positioned in said first groove, the cup rim pressing said gasket means into said first groove when said lid is attached to the cup for sealing said second groove and for sealing said lid to the paint cup rim, said lid further having a first passage connecting said second groove to the interior of the paint cup and a second passage spaced from said first passage connecting said second groove with atmosphere exterior to the paint cup.

2. An improved vented closure for a paint cup, as set forth in claim 1, wherein said second annular groove extends less than 360 degrees about said lid, and wherein said first and second passages are located adjacent opposite ends of said second annular groove.

3. In a suction feed paint sprayer including a paint cup having an upper annular rim and a lid mounting an annular resilient gasket recessed within a first annular groove and located for abutting said rim to seal said lid to said cup rim, an improved vent structure wherein said lid has a second annular groove having a side opening into said first annular groove substantially in alignment with said rim, wherein said rim presses said gasket into said first groove to close said open side of said second groove when said gasket is positioned in said first annular groove and said lid is attached to said cup and said second annular groove is exposed for cleaning when said gasket is removed from said first annular groove, said lid further including a first passage connecting said second annular groove with the interior of said paint cup and a second passage spaced from said first passage connecting said second annular groove with the atmosphere exterior to said paint cup.

4. An improved vent structure for a paint cup, as set forth in claim 3, wherein said second annular groove extends less than 360 degrees about said lid, and wherein said first and second passages are located adjacent opposite ends of said second annular groove.

5. In a suction feed paint sprayer including a paint cup having an upper annular rim and a lid mounting an annular resilient gasket recessed within a first annular groove and located for abutting said rim to seal said lid to said cup rim, an improved vent structure wherein said lid has a second annular groove extending less than 360° about the lid and having a side opening into said first annular groove, wherein said gasket closes said open side of said second annular groove when positioned in said first annular groove and exposes said second annular groove for cleaning when removed from said first annular groove, said lid further including a first passage connecting one end of said second annular groove with the interior of said paint cup and a second passage spaced from said first passage connecting an opposite end of said second annular groove with the atmosphere exterior to said paint cup, a valve means located in said lid at the end of said second annular groove connected to said first passage, said valve means having a first position connecting said first passage to the adjacent one annular groove end and having a second position directly connecting the interior of said paint cup to the atmosphere and bypassing substantially all of said second annular groove.

6. An improved vent structure for a paint cup, as set forth in claim 5, whereins said first passage is located in said valve means.

7. An improved vent structure for a paint cup, as set forth in claim 5, wherein, said valve means includes a third passage extending through said lid, said gasket closing said third passage when said valve means is in said first position and said third passage venting said paint cup to the atmosphere when said valve means is in said second position.

8. For a suction feed paint spray gun, an improved vented closure for a paint cup comprising a lid having a first annular groove positioned for abutting a rim on the paint cup and second annular groove located within said first annular groove and extending less than 360° about said lid, removeable gasket means positioned in said first groove for sealing said second groove and for sealing said lid to the paint cup rim, said lid further having a first passage connecting one end of said second groove to the interior of the paint cup and a second passage spaced from said first passage connecting an opposite end of said second groove with atmosphere exterior to the paint cup, a valve means located in said lid at said one end of said annular groove connected to said first passage, said valve means having a first position connecting said first passage to the adjacent one annular groove end and having a second position directly connecting the interior of said paint cup to the atmosphere and bypassing substantially all of said second annular groove.

9. In a suction feed paint sprayer including a paint cup having an upper annular rim and a lid mounting an annular resilient gasket recessed within a first annular groove and located for abutting said rim to seal said lid to said cup rim, an improved vent structure wherein a closed second annular groove is formed between said lid and said gasket substantially in alignment with said cup rim, wherein said second groove is exposed for cleaning when said gasket is removed from said first groove, means defining a first passage for connecting said second groove with the interior of said paint cup, and means defining a second passage spaced from said first passage for connecting said second annular groove with the atmospheric exterior to said paint cup.

10. An improved vent structure for a paint cup, as set forth in claim 9, wherein said second annular groove extends less than 360 degrees about said lid, and wherein said first and second passages are located adjacent opposite ends of said second annular groove.

11. In a suction feed paint sprayer including a paint cup having an upper annular rim and a lid mounting an annular resilient gasket recessed within a first annular groove and located for abutting said rim to seal said lid to said cup rim, an improved vent structure wherein a closed second annular groove is formed between said lid and said gasket to extend less than 360° about said lid, wherein said second groove is exposed for cleaning when said gasket is removed from said first groove, means defining a first passage for connecting one end of said second groove with the interior of said paint cup, means defining a second passage spaced from said first passage for connecting an opposite end of said second groove with the atmosphere exterior to the paint cup, valve means located in said lid at said one end of said second annular groove connected to said first passage, said valve means having a first position connecting said first passage to the adjacent one annular groove end and having a second position more directly connecting the interior of said paint cup to the atmosphere.

* * * * *